United States Patent [19]

Egan

[11] 4,065,124

[45] Dec. 27, 1977

[54] HIGH-BOUNCE AMUSEMENT AND EXERCISE AIR BAG

[76] Inventor: Michael F. Egan, 16 Rose St., Timonium, Md. 21204

[21] Appl. No.: 709,604

[22] Filed: July 29, 1976

[51] Int. Cl.[2] ..... A63B 5/00

[52] U.S. Cl. ..... 272/65

[58] Field of Search ..... 272/65, 101, 109, 130, 272/46, 1 R, 70; 46/44, 86 A, 86 B, 86 C; 124/61, 64, 56 R; 128/DIG. 24

[56] References Cited

U.S. PATENT DOCUMENTS

| | | | |
|---|---|---|---|
| 3,130,816 | 4/1964 | Wright | 272/65 |
| 3,176,982 | 4/1965 | O'Daniell | 272/65 X |
| 3,578,318 | 5/1971 | Young | 272/1 R |
| 3,744,472 | 7/1973 | O'Ryan | 124/61 |
| 3,870,304 | 3/1975 | Minnick | 124/56 X |
| 3,963,026 | 6/1976 | Herb | 128/DIG. 24 X |

*Primary Examiner*—Harland S. Skogquist
*Assistant Examiner*—William R. Browne
*Attorney, Agent, or Firm*—John F. McClellan, Sr.

[57] ABSTRACT

An air bag large enough for several children to jump on at one time is equipped with one or more bellows centrally on the top surface providing means for children safely to propel one another for great vertical distances, being assured of cushioning of the fall when they return by the perimeter of the bag. Preferably the bag is of the constant-volume or non-stretching type so that jump-on compression of any portion of the bag results not in stretching the bag but instead efficiently snaps the bellows structure out to the full extent, and upon relaxation permits the bellows structure to collapse instead of remaining distended.

Similarly the bellows structure is preferably of the non-stretch material and preferably has a top reinforcement and an elastic return which may be a spring.

2 Claims, 5 Drawing Figures

HIGH-BOUNCE AMUSEMENT AND EXERCISE AIR BAG

This invention relates generally to amusement devices and specifically to a pneumatic jumping bag.

In the prior art various pneumatic amusement devices have been described, exemplified by the following U.S. Patents:

U.S. Pat. No. 3,730,518 to J. E. Drapcho — May 1, 1973

U.S. Pat. No. 3,578,318 to J. F. Young — May 11, 1971

U.S. Pat. No. 3,176,982 to O. O'Daniell — Apr. 6, 1965

U.S. Pat. No. 1,081,554 to G. C. Rodeck — Dec. 16, 1913

Drapcho discloses a foam base with a plurality of foam cylinders as a bounce-against toy.

Young discloses a hose-connected assemblage of bellows for seesaw type-play.

O'Daniell discloses inflatable dome structure for bouncing type play. Rodeck discloses an inflatable rotatable platform for ejecting riders during play.

However, none of the prior art known provides the type amusement with fool-proof safety features and efficiency and economy size-for-size according to objects of the present invention.

Further objects of the present invention are to provide an attractive visually interesting device which is fun for observers to watch as well as for participants to play upon, and which can offer amusement to both classes whenever one child plays upon it.

A further object is to provide an amusement device as described which provides a higher bounce or player projection with safety than previously described devices of the kind.

Still further objects are to provide a unitary amusement device as described which requires no set-up other than inflation, which requires no preparation for shipment or storage beyond deflation and folding, which is reliable, durable and easy to repair, foolproof, stable but lightweight, economical to manufacture, and reasonable in purchase price.

In brief summary given for purposes of cursory description only, the invention includes an air bag amusement device with one or more retractive central sections thereof extensible upon compression of the air bag by a person jumping on it.

The above and other objects and advantages of the invention will become more readily apparent on examination of the following description, including the drawings in which.

Figure 1:
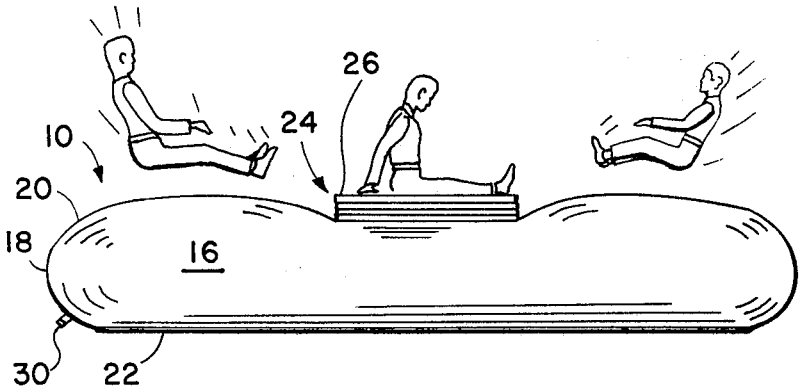
FIGS. 1 and 2 are side elevational views of an embodiment of the invention in use.
Figure 2:
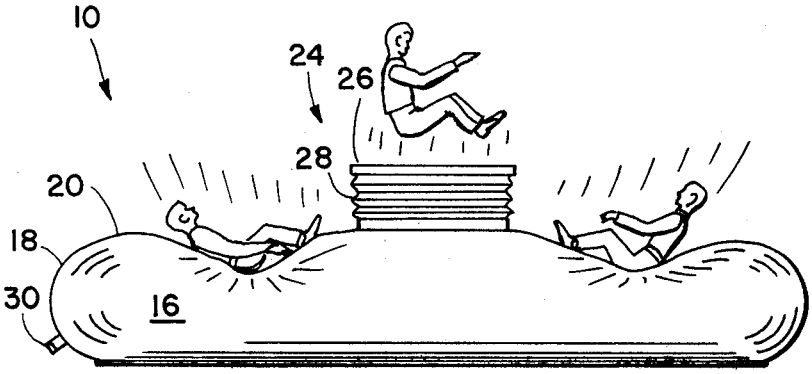

FIGS. 1 and 2 show embodiment 10 of the invention which comprises an air bag body 16 in circular form, preferably with a vertically rounded periphery 18 generally planar upper 20 and lower 22 surface, a central upwardly extensible, inverted-cup-shaped bellows 24 closed by a relatively strong and rigid, generally planar bellows top 26 of larger diameter than the bellows sidewall 28 and sealed around the lower periphery to the air bag body. A conventional filler 30 is provided. The air bag and bellows structure are preferably of non-stretch material such as canvas or nylon or other fabric reinforced or fiber filled rubber or plastic, so that when the air bag is barely filled and compressed, all the displaced gas efficiently pops into the bellows, which being also of non-stretch material, snaps upward in extension. The larger diameter of the bellows top, which may be of covered plywood, assures that it will remain in operative position on the top surface, since the opening below the bellows is somewhat smaller in diameter, although not greatly, for reasons of efficiency and stability.

When one or more players jump onto the periphery they plunge in, instantly displacing gas to the bellows and ejecting upward a player on the bellows top. The ejected player is in no danger of falling off onto the hard ground since the yielding margin of the bellows extends by design a distance sufficient to receive and cushion the fall of the ejected player, and the rounded edges provide an easy letdown slope. The air bag may advantageously measure eight feet (2.44m) or more in diameter and the bellows may be 16 inches (40.6 cm), or more as indicated, in diameter. The air bag may be 2 feet (61 cm) in height and the bellows may rise sixteen inches or more in full distension. Smaller diameters down to 6 feet and larger diameters up to ten feet may be provided in relatively lightweight materials, such as those used in railway cushion bags and in lightweight collapsible life rafts and dinghies.

Preferably the bellows sidewalls have elastic-retraction means for quick recovery. This may be in the form of a spring.

Figure 3:
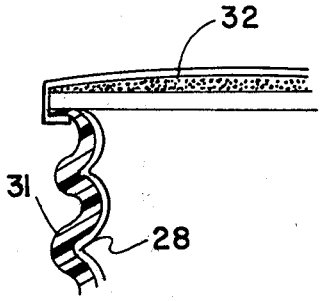
FIG. 3 is a sectional view of the bellows of FIG. 2.

FIG. 3 shows in section that the bellows sidewall 28 may include a layer of polypropylene 31 heat-molded to spring shut upon relaxation of pressure in the bellows. Any conventional alternative apparatus such as elastic straps spanning the bellows may be used for the same purpose. The bellows top is preferably padded as at 32 with foam rubber or the like. The bottom may have a reinforcing doubler 436. Visual instructions such as representations of children jumping may also be provided, preferably in color.

Figure 4:
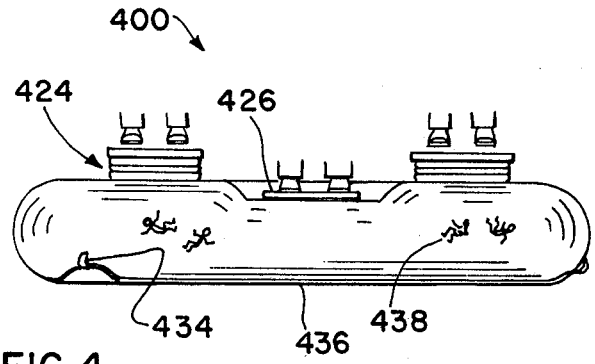
FIG. 4 is a side elevational diagrammatic view of a further embodiment.
Figure 5:
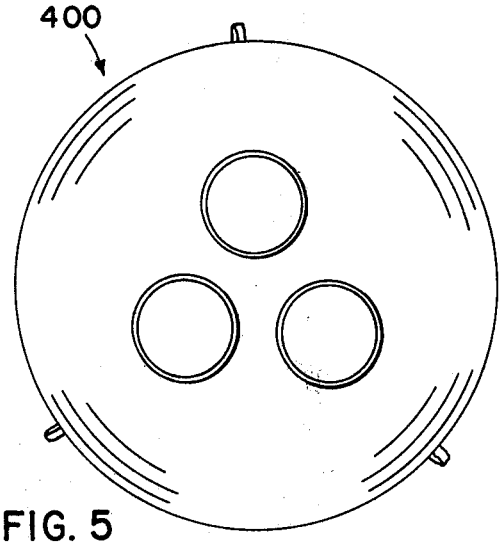
FIG. 5 is a plan view.

FIG. 4 diagrams in side elevation and FIG. 5 shows in plan view a further embodiment 400 of the invention in which plural centrally located bellows 424, laterally positioned with respect to each other, are used. The tops 426 of the bellows can be used for standing jumping platforms more stable than the less rigid fabric sides, with the same enjoyable results for plural players. It is evident that in the alternative one player jumping up and down on one bellows top will cause an amusing pop-up and down of the other bellows. Loops 434 may be used for tie-down anchoring to trees or stakes on windy days or during vacations.

This invention is not to be construed as limited to the particular forms disclosed herein, since these are to be regarded as illustrative rather than restrictive. It is, therefore, to be understood that the invention may be practiced within the scope of the claims otherwise than as specifically described. What is claimed and desired to be protected by U.S. letters patent is:

1. In an amusement and exercise air bag for one or more players, the improvement comprising: a rounded air bag body having generally planar upper and lower surfaces; bellows structure, the bellows structure having pneumatic connection with the air bag body at the upper central portion of the air bag body, comprising the bellows structure being generally inverted-cup-shaped with the lower periphery having sealing connection at an opening in the air bag body for unrestricted passage of air between the bellows structure and the air bag body; the bellows structure being upwardly distendable from the air bag body upon compression of the air bag body for upwardly projecting a player resting thereon and having associated therewith resilient bellows-retractive structure, the bellows structure having relatively rigid top structure larger in diameter than said lower periphery for preventing the rigid top structure from being pressed below the air bag upper surface, and the air bag body extending as a safety margin around the bellows structure.

2. In an amusement and exercise air bag as recited in claim 1, a plurality of said bellows structures laterally positioned relative to each other centrally in the air bag upper surface.

* * * * *